US006847335B1

(12) United States Patent
Chang et al.

(10) Patent No.: US 6,847,335 B1
(45) Date of Patent: Jan. 25, 2005

(54) SERIAL COMMUNICATION CIRCUIT WITH DISPLAY DETECTOR INTERFACE BYPASS CIRCUIT

(75) Inventors: Chen-Jen Jerry Chang, North York (CA); Erwin Pang, Richmond Hill (CA); David Chih, Scarborough (CA)

(73) Assignee: ATI International SRL, Barbados (KN)

( * ) Notice: Subject to any disclaimer, the term of this patent is extended or adjusted under 35 U.S.C. 154(b) by 0 days.

(21) Appl. No.: 09/181,973

(22) Filed: Oct. 29, 1998

(51) Int. Cl.[7] ..... G09G 5/00

(52) U.S. Cl. ..... 345/3.1; 345/1.1; 345/504; 345/520; 348/121; 348/123

(58) Field of Search ..... 345/1–3, 903, 345/502–506, 519, 520; 348/121, 123

(56) References Cited

U.S. PATENT DOCUMENTS 5,727,191 A * 3/1998 Konishi et al. ..... 345/698
5,874,928 A * 2/1999 Kou ..... 345/1.1
5,953,074 A * 9/1999 Reddy ..... 348/558
5,963,192 A * 10/1999 Wong et al. ..... 345/502
6,028,585 A * 2/2000 Ishii et al. ..... 345/132

* cited by examiner

*Primary Examiner*—Amare Mengistu
*Assistant Examiner*—Jimmy H. Nguyen
(74) *Attorney, Agent, or Firm*—Vedder, Price, Kaufman & Kammholz

(57) ABSTRACT

A circuit and method serves as a slave interface to support both register read/write and monitor detection operations by a graphics controller chip, or other display data source, with a plurality of display devices. The circuit supports differing monitor detection protocols including, for example, $I^2C$ protocol and non-DDC type protocols. The circuit may be set in two modes, a register mode and a bypass mode. The register mode is used to facilitate standard $I^2C$ protocol to a display device. Display detection bypass circuitry is used to selectively bypass the register based display detector interface by connecting input pins to any two of a plurality of I/O pins so that the system may be used for monitor detection of a plurality of different display devices, such as CRTs and LCDs to facilitate multiprotocol display detection.

23 Claims, 4 Drawing Sheets

SERIAL COMMUNICATION CIRCUIT WITH DISPLAY DETECTOR INTERFACE BYPASS CIRCUIT

FIELD OF THE INVENTION

The invention relates generally to systems and methods for detecting a type of display device, and more particularly to serial communication systems and methods that facilitate display detection for a plurality of display devices.

BACKGROUND OF THE INVENTION

Graphics controllers are used in a wide variety of applications to enhance graphics processing and display capabilities for devices such as laptop computers, desktop computers, portable communication devices and other devices having displays. Some computer units and communication devices allow connection to multiple display devices. For example, a graphics controller may provide display data to a cathode ray tube (CRT) monitor, a liquid crystal display (LCD) monitor, or other types of monitors. The differing refresh rates and resolutions of the differing multiple display devices must be accounted for by the graphics controller to suitably display image data simultaneously on multiple display units.

Monitor detection standards are typically classified into three types: DDC2B, DDC1, and others. Typically upon initialization, a graphics controller chip or other controller communicates in a standard serial monitor detection communication protocol such as $I^2C$ (DDC1, and DDC2B protocols), or in a non-DDC protocol (such as may be used by Apple Computer® Company based monitors) to facilitate monitor detection. For example, with Inter-IC Control ($I^2C$) monitor detection protocol developed by Philips Semiconductor in about 1995, the graphics controller chip (serving as a master controller) initiates commands or requests to a CRT (which serves as a slave device) to detect the type of monitor. The CRT responds indicating resolution information and other information necessary for the graphics controller chip to suitably generate display data for the display device. One mechanism for monitor detection includes the use of a register based monitor detection interface to be used to facilitate this communication. Data registers are used to facilitate serial to parallel conversion to or from the graphics controller with the display device. A direction register controls the direction of input/output ports on the graphics controller to suitably communicate to allow the graphics controller to detect the type of display device being connected with the graphics controller. The registers and control are typically located on the graphics chip and dedicated to the monitor detection function.

Systems are known that have a graphics controller chip that provides data to multiple differing display devices. Generally, a two-line (two pin) connection is made between the multiple display devices and the graphics controller chip. One line is used for serial data and the other line is used for a serial clock signal. Also, when attempting to display information from a single data source over multiple displays, ratiometric expansion must typically be used to interpolate, stretch or scale the image on a screen having a larger resolution.

Many graphics controller chips have been sold that were originally designed for digital display outputs without a companion chip such as a chip serving as a ratiometric expander that may be needed for expanding data to accommodate display on different resolution displays. With the desire for companion chips, it is desirable to have control over such as chip without requiring additional pins while maintaining the original monitor detection capability.

Consequently, a need exists for a device and method to facilitate serial communication between a display data source and a plurality of display devices where differing protocols may be used for the different types of display units. It would be desirable if such a device could be connected to existing graphics controller chips to facilitate monitor detection with a plurality of different types of display devices and to allow use of existing monitor detection pins in a multipurpose fashion to control a companion circuit (or chip) and to support a plurality of different types of display devices in addition to multi-pin monitor detection. In addition, it would be desirable if such a device minimized interface complexity to facilitate a smaller circuit size to reduce cost and improve reliability.

DETAILED DESCRIPTION OF A PREFERRED EMBODIMENT OF THE INVENTION

Briefly, a device and method supports both register read/write and monitor detection operations by a graphics controller chip, or other display data source through a two-wire communication circuit, with a plurality of display devices. The device may support differing monitor detection protocols including, for example, DDC1, DDC2B protocol and non-DDC type protocols. The device may be set in two modes, a register mode and a bypass mode. The register mode is used to facilitate standard $I^2C$ protocol to a display device. Display detection bypass circuitry is used to selectively bypass the register based display detector interface by connecting input ports to any two of a plurality of I/O ports (pads) so that the system may be used for monitor detection of a plurality of different display devices, such as CRTs and LCDs. Hence, the system facilitates multiprotocol display detection. The plurality of I/O ports form a group of shared bidirectional ports that selectively communicate data with a plurality of display devices either through the register based display detection interface or the display detection bypass circuit.

Figure 1:
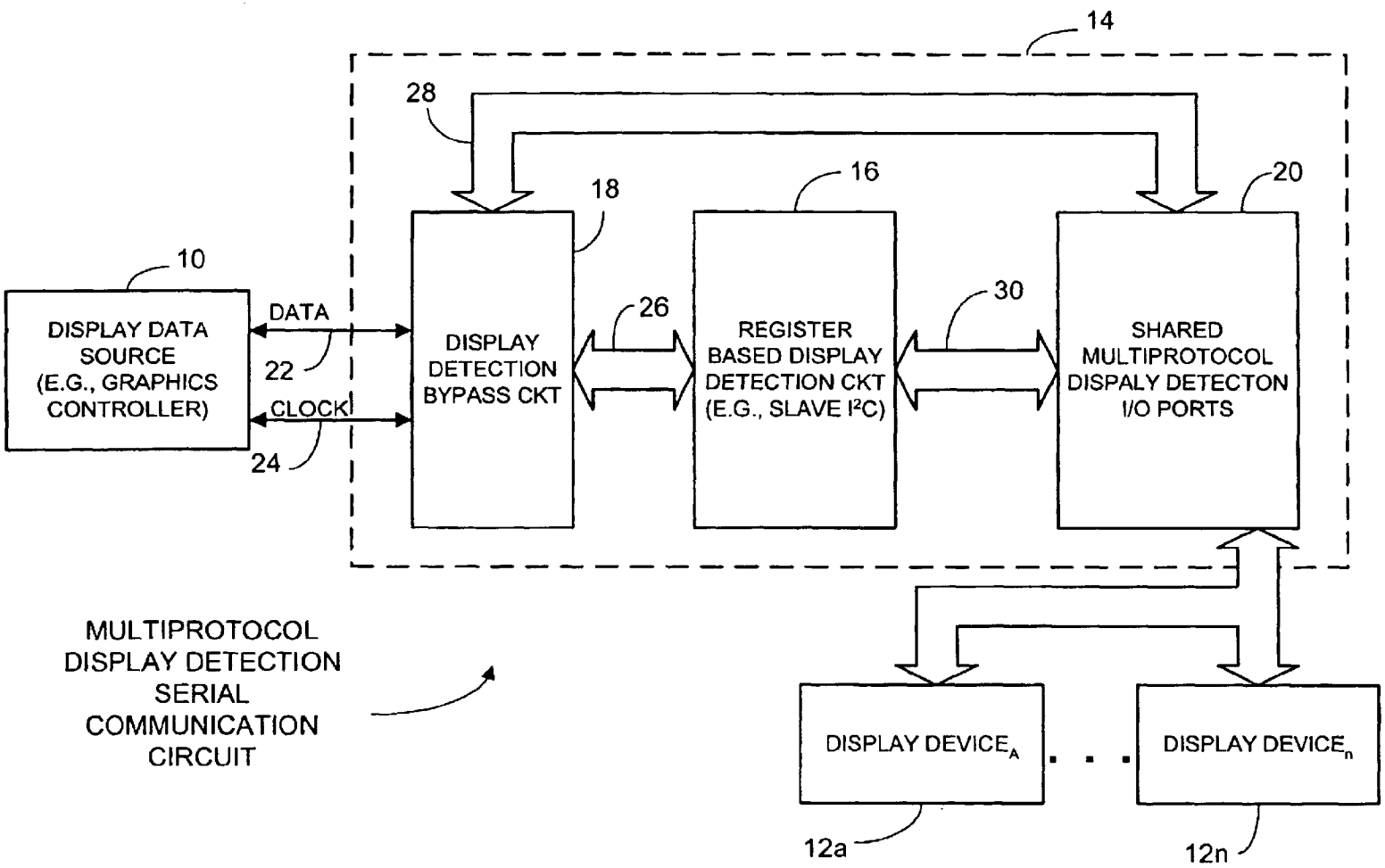
FIG. 1 is a block diagram illustrating an example of one embodiment of a serial communication circuit for facilitating communication between a display data source and a plurality of display devices in accordance with the invention.

FIG. 1 shows a display data source 10 operatively coupled to a plurality of display devices 12*a*–12*n* through a serial communication circuit 14. The display data source 10 may be, for example, a graphics controller such as a video graphics chip containing graphics processing circuitry, or other suitable display data source. The plurality of displays 12*a*–12*n* may include, for example, one display that is a CRT, and another display that is an LCD display, wherein the CRT and LCD displays have different resolutions. In addition, the displays may include non-DDC compatible displays such as those manufactured by Apple® Computer Corporation or other vendor. The display data source 10 serially communicates with the plurality of display devices 12*a*–12*n* using any suitable protocol. For example, during monitor detection, the display data source 10 may communicate with display 12*a* using $I^2C$ protocol and may also be required to perform monitor detection with another display 12*n* using a different protocol.

The serial communication circuit 14 includes a register based display detection interface circuit 16, a display detection bypass circuit 18 and shared multiprotocol display detection I/O ports 20. The communication circuit 14 is operatively coupled to the display data source 10 through at least a pair of signal lines 22 such as a signal line dedicated for serial data (SDA), and signal line 24 that may be used, for example, to communicate serial clock data (SCL). The display detection bypass circuit 18 is coupled to the shared multiprotocol display detection I/O ports 20. A portion of the display detection bypass circuit 18 is also operatively coupled with the register based display detection interface circuit 16 through suitable signal links 26. The display detection bypass circuit 18 is coupled to the shared multiprotocol I/O ports through suitable signal lines 28.

The register based display detection interface circuit 16 is operatively coupled through bus lines 30 to the shared multiprotocol display detection I/O ports 20. The register based display detection interface circuit 16 may be a conventional register based $I^2C$ interface circuit as known in the art. The shared multiprotocol display detection I/O ports 20 are shared bidirectional ports that selectively communicate data with the plurality of display devices 12*a*–12*n* wherein the data is obtained from the register based display detection interface circuit 16 or alternatively through the display detection bypass circuit 18.

The display detection bypass circuit 18 selectively bypasses the register based detector interface circuit 16 to facilitate multiprotocol display detection for the display data source 10. Hence, when different types of displays are being supported by the display data source 10, the display data source 10 may perform monitor detection operations through each of the differing display devices to determine suitable display resolutions and refresh rates and other information to facilitate display of data.

Figure 2:
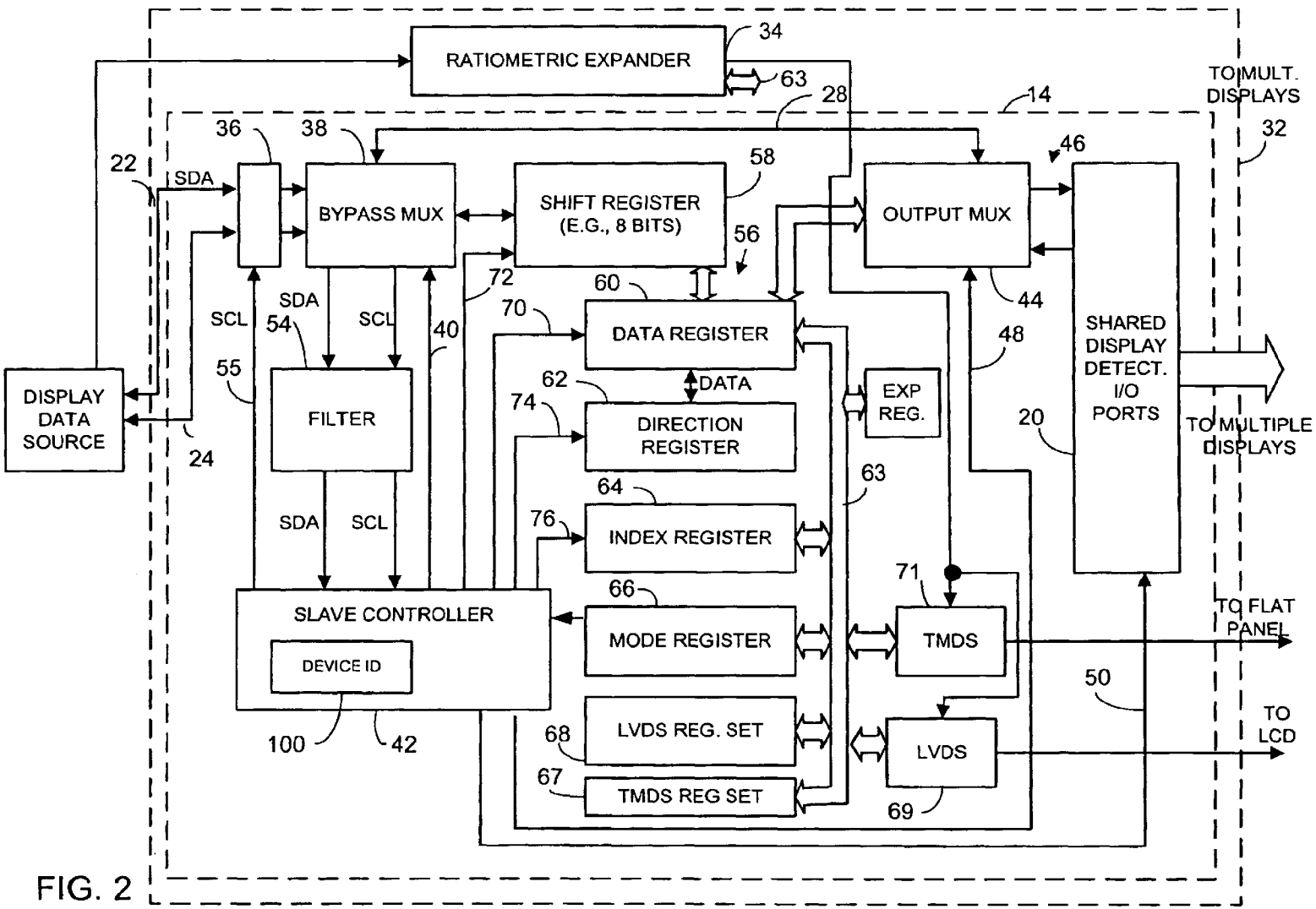
FIG. 2 is a more detailed block diagram of the circuit of FIG. 1.

FIG. 2 shows a display data expander 32 with a ratiometric expansion engine 34 containing the serial communication circuit 14. The multiprotocol display detection serial communication circuit 14 includes graphics controller serial communication ports 36. One port is used for communicating serial data signal 22 and the other port used for communicating serial clock signal 24. The display detection bypass circuit 18 includes a bypass multiplexing circuit 38 that receives a control signal 40 from a slave control circuit 42. The bypass multiplexing circuit 38 also includes an output multiplexing circuit 44 which is coupled to the bypass multiplexing circuit 38 to communicate selected display detection data from the bypass multiplexing circuit through signal lines 28. The output multiplexing circuit 44 receives an output multiplexing control signal 48 from the slave controller 42 to control direction of data flow through the output multiplexing circuit. The output multiplexing circuit 44 is also coupled through the signal lines 46 to the shared multiprotocol display detection I/O ports 20 to output data over the ports or receive data from the ports.

During the bypass mode, the slave controller 42 generates a direction control signal 50 to the shared multiprotocol display detection I/O ports 20 to set the requisite ports in an output or input mode depending upon whether data is being output from the ports or received by the ports. The direction control signal 50 is used to facilitate multiprotocol communication with a plurality of display devices by selectively activating the appropriate ports for communication. Control signal 40 controls activation of the bypass multiplexer to bypass data directly to the output multiplexing circuit. Communication port enable signal 48, generated by the slave controller, controls the output multiplexing circuit 44 to allow bidirectional communication directly from the communication port 36. The slave controller 42 also generates a direction enable signal 55 during the bypass mode to allow bidirectional communication directly from the shared I/O ports 20 to the serial communication pads 36.

In this embodiment the display data expander 32 is located on a separate integrated circuit from the display data source 10, such as a graphics controller chip or other master control logic. The display data expander 32 includes a ratiometric expander 34 as previously indicated. The ratiometric expander 34 ratiometrically expands display data received from the display data source 10 for display on at least one of the plurality of display devices after monitor detection has been completed. It will be recognized that any suitable functionality may also be used. For example, the device 32 may include a frame modulator, dithering block, centering logic or any other suitable video processing logic.

The serial communication circuit 14 also includes a filter 54 coupled between the bypass multiplexing circuit 38 and the slave controller 42 to remove noise from data received from the data source 10. The serial communication circuit 14 also includes a set of registers generally indicated at 56 including a shift register 58, data register 60, direction register 62, index register 64, mode register 66 and LVDS register 68. The display data expander 32 includes a low voltage differential signaling (LVDS) block 69, such as an LVDS type developed by National Semiconductor, as known in the art. The LVDS block 69 serves as a high speed low voltage analog transmitter that transmits display data and clock data serially to a display device such as an LCD notebook display panel. Its advantages include low power consumption, low EMI emissions and low cost making it suitable for portable display devices. Also if desired, another type of differential signaling may be incorporated, such as transition minimization differential signaling (TMDS) developed by Silicon Image Inc. that has been adopted as a Video Electronics Standard Association (VESA®) plug and display standard (P&D™).

A TMDS block 71 is also a high speed low voltage analog transmitter that transmits display data and clock data serially to a display device such as a desktop flat panel. The data is encoded before transmission to insure minimal transitions and to facilitate DC balanced signals. In addition to similar advantages as LVDS, TMDS based transmitters can also tolerate a relatively high amount of skew among the transmitted signals making such transmitters suitable for remote display devices such as a flat panels and distant display set up connected via fiber optic cables. The TMDS block 71 uses the TMDS register set 67 to facilitate operation. The TMDS registers and LVDS registers are programmed using the port 36 through the bypass multiplexer and shift register through bus 63. Also, ratiometric expansion registers are programmed using the two pin port 36. Hence the general operations of the companion chip (e.g., non-monitor detection circuits) are also controlled using the monitor detection pins.

The registers 56 form part of the registered based display detection interface as known in the art. With the register mode, the graphics controller serves as a master to perform normal register read/write operations to facilitate $I^2C$ monitor detection protocol, non-DDC protocol or other suitable protocol. The shift register 58 serves as a serial-to-parallel converter of serial data signal 22 received through the bypass multiplexer when the bypass mode is not active. This data is then stored in the data register 60. The slave controller 42 generates a read/write control command signal 70 to either write data from the data register 60 or allow the reading of data from the data register 60. The data stored in shift register 58 is dumped into the data register upon receipt of a data dump command 72 from the slave controller 42. Similarly, data stored in data register 60 is loaded into the shift register upon receipt of a data load command from the slave controller. The index register 64, as known in the art, contains an index address pointer to a target register index address. A direction register signal 74 controls whether data is received from the data register. The content of the direction register controls the direction of the shared ports during the register mode. An index register update signal 76 updates the index register 64 to indicate which register in the LVDS register set and TMDS register sets and other control register sets to access.

The LVDS register set 68 and TMDS register set 67 include registers that contain data to control LVDS and TMDS transmitter voltage level, phase lock loop frequencies, swing control and other miscellaneous analog set up controls for the LVDS and TMDS blocks. The ratiometric expansion engine 34 uses registers containing display information such as resolutions and other digital configuration data. The resolution data is used to determine the amount of ratiometric expansion needed to suitably display data on an LCD or other display, as known in the art. The ratiometric expansion engine 34 obtains the resolution data used to store resolution data from monitor detection process through bus 63. Hence, the display data expander 32 combines a ratiometric expansion engine 34 (including suitable registers) with a serial communication circuit to facilitate multipurpose functionality using common pins.

If desired, the default mode for the serial communication circuit 14 may be to use the register based display detection interface circuit. In this mode, the bypass path (lines 46) between the bypass multiplexer 38 and output multiplexer 44 are effectively disconnected such that the graphics controller or data source can only access the internal registers 56. Hence the serial communication circuit 14 is selectable between the bypass mode activating the display detection bypass circuit and a register mode that activates the register based display detection interface circuit. The display data source 10 activates either the bypass mode or register mode using the mode register 66. The mode register 66 contains bypass control data, such as bits indicating whether to activate the display detection bypass circuit 18.

During the bypass mode, $I^2C$ protocol (e.g., DDC1 and DDC2B) or other suitable protocol, may be used and the appropriate shared multiprotocol display detection I/O ports are selected for serial communication directly from the display data source bypassing the registered based display detection interface circuit. The display detection bypass circuit is used during monitor detection process performed by the graphics controller and receives data from the graphics controller which is sent out through the ports 20 or receives data from ports 20 as received from the display devices in response to data (including clock signals) generated by the graphics controller. The display detection bypass circuit enables a pass through of the serial data and serial clock information to any two of the shared multiprotocol display detection I/O ports which are used for monitor detection of both CRTs, LCDs and any other suitable monitor.

The slave controller 42 uses the mode register as a control register that can be controlled by the display data source to selectively activate the display detection bypass circuit. The controller register may include, for example, a bypass mode enable bit, a serial clock pulse enable bit, a serial data bypass select bit, a serial clock bypass select bit and any other suitable information. To change the circuit 14 from register mode to bypass mode, the display data source sets the bypass enable bit in the bypass control register. By way of example, three bits in this register may be used to select shared ports for serial data bypass and three bits may be used to select a shared port for the bypass the register circuit for serial clock data. Any port may be selected for either serial data or serial clock communication to facilitate multiprotocol communication with a plurality of differing display devices. As such, if there are eight I/O ports, eight monitor signals can communicate with a host or display data source through the two wire $I^2C$ connection ports. The shift registers and slave controller 42 facilitate serial-to-parallel and parallel-to-serial conversion to encode and decode eight data channels for input and output data communications.

As indicated above, the bypass mode is used for monitor detection. For DDC2B monitors, the display detection bypass circuit is enabled for corresponding ports so that the display data source can directly communicate with the monitors through the shared ports. For DDC1 monitors, several methods may be used. One may include bypassing extended display identification data (EDID) data in port to the serial data line 22. This allows the display data source to sample the data directly. The serial clock signal port should be set to ensure that all clock signals come from the data source. Another method may include, for example receiving a clock pulse from a display data source or other source, sampling any received data internally and storing data in a temporary shift register using the SCL line 24 to clock data in or out through the serial communication circuit at a desired rate. For example, the data source may receive a vertical synchronization pulse that may be used by the data source to clock data. In this way, the display data source can read data from the register in a suitable time by controlling the clock signal to help ensure that no underflow or overflow of registers occurs.

For non DDC-type monitors, such as monitors manufactured by Apple® Computer Company, monitor detection is accomplished in the register mode by encoding and decoding data from the shared ports in a byte format or other suitable format and sending the information across the two port data and clock signals 22 and 24.

Figure 3:
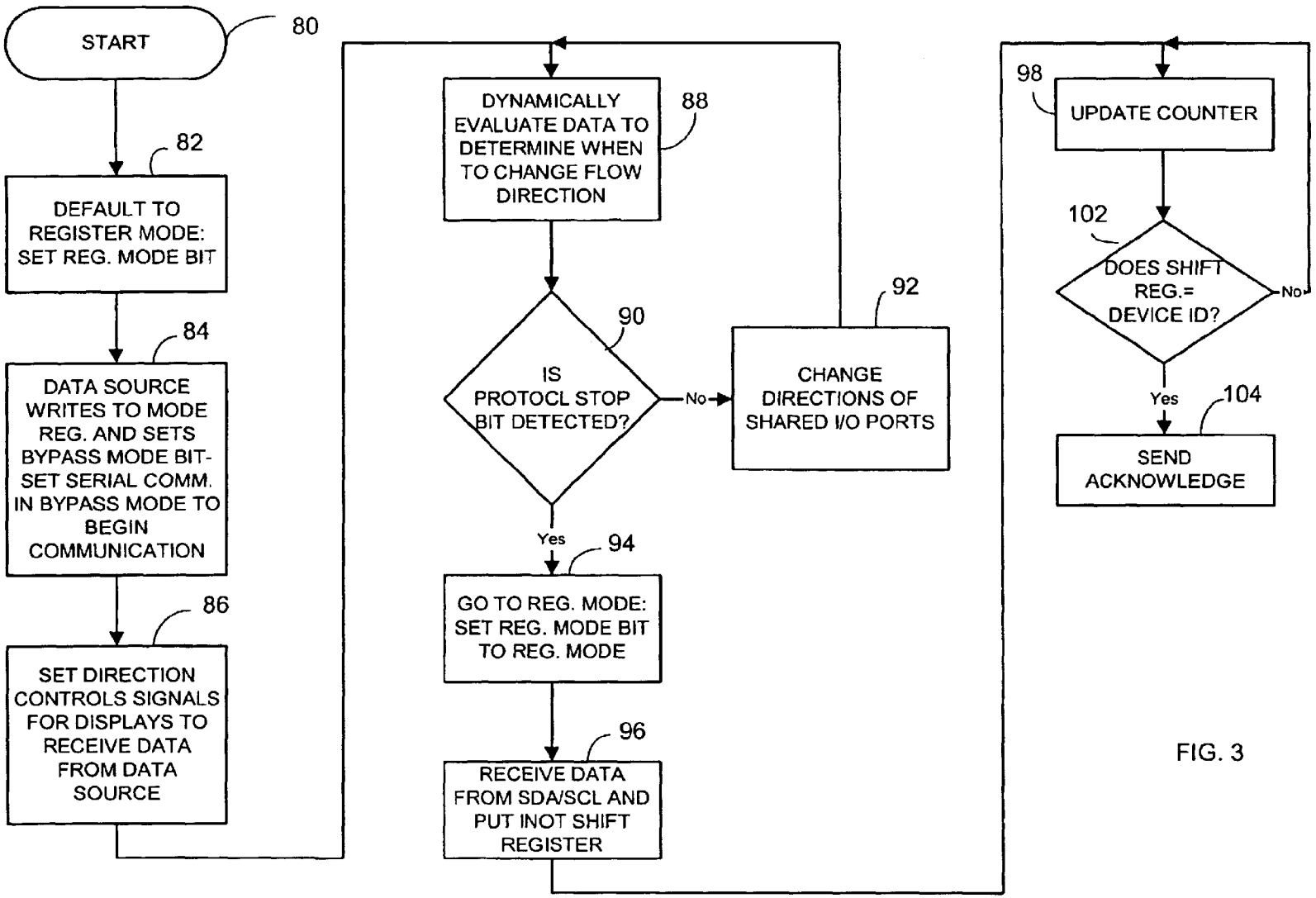
FIG. 3 is a flowchart depicting a method for facilitating communication with a plurality of display devices in accordance with one embodiment of the invention.

As shown in FIG. 3, the display detection serial communication circuit 14, display data source 10 and displays 12 interact as follows. As shown in block 80, the serial communication circuit is powered on. As shown in block 82, the mode register is defaulted to activate the register based display detection circuit. To activate the bypass mode, the display data source 10, or other source, writes to the mode register to set the bypass mode bit to begin the monitor detection process as shown in block 84. The slave controller sets the appropriate control signals to set the direction for the displays to receive data from the display data source as shown in block 86. For example, the direction enable signals 55 for the communication pads are appropriately set, and the shared bidirectional ports are appropriately set by enable signal 50.

As shown in block 88, the slave controller 42 continuously (dynamically) monitors data to determine when to change flow direction to allow communication from or to the display data source 10 and the display devices. For example, when using $I^2C$ protocol the slave controller monitors the signals 22 and 24 through the bypass multiplexing circuit 38 and filter 54 to determine if an $I^2C$ stop data bit has been detected from the display data source 10 as shown in block 90. If the stop data bit has not been detected, the slave controller 42 determines the direction of the input/output serial communication pads and shared I/O ports to switch direction every eight bits as shown in block 92. If the stop data has been detected, the slave controller, for example, sets the mode bit in the mode register 66 through bus 63 to set the bit back to register mode to disable the display detection bypass circuit. This is shown in block 94. As shown in block 96, the system now operating in the register mode, receives signals 22 and 24 and stores them in the shift register 58, as shown in block 96. A counter (not shown) is set to determine whether or not the shift register is full as shown in block 98. When full, the slave controller determines whether the contents of the shift register correspond to device identification data 100 indicating that the serial communication circuit is a recognizable device to the data source as shown in block 102. Device ID data is prestored in circuit 14 memory, or set through external communication, and represents a number or other identification data of the serial communication circuit. If there is a match between the data sent by the controller indicating what it thinks is the serial communication circuit and device ID data, an acknowledgement is sent back to the data source.

Figure 4:
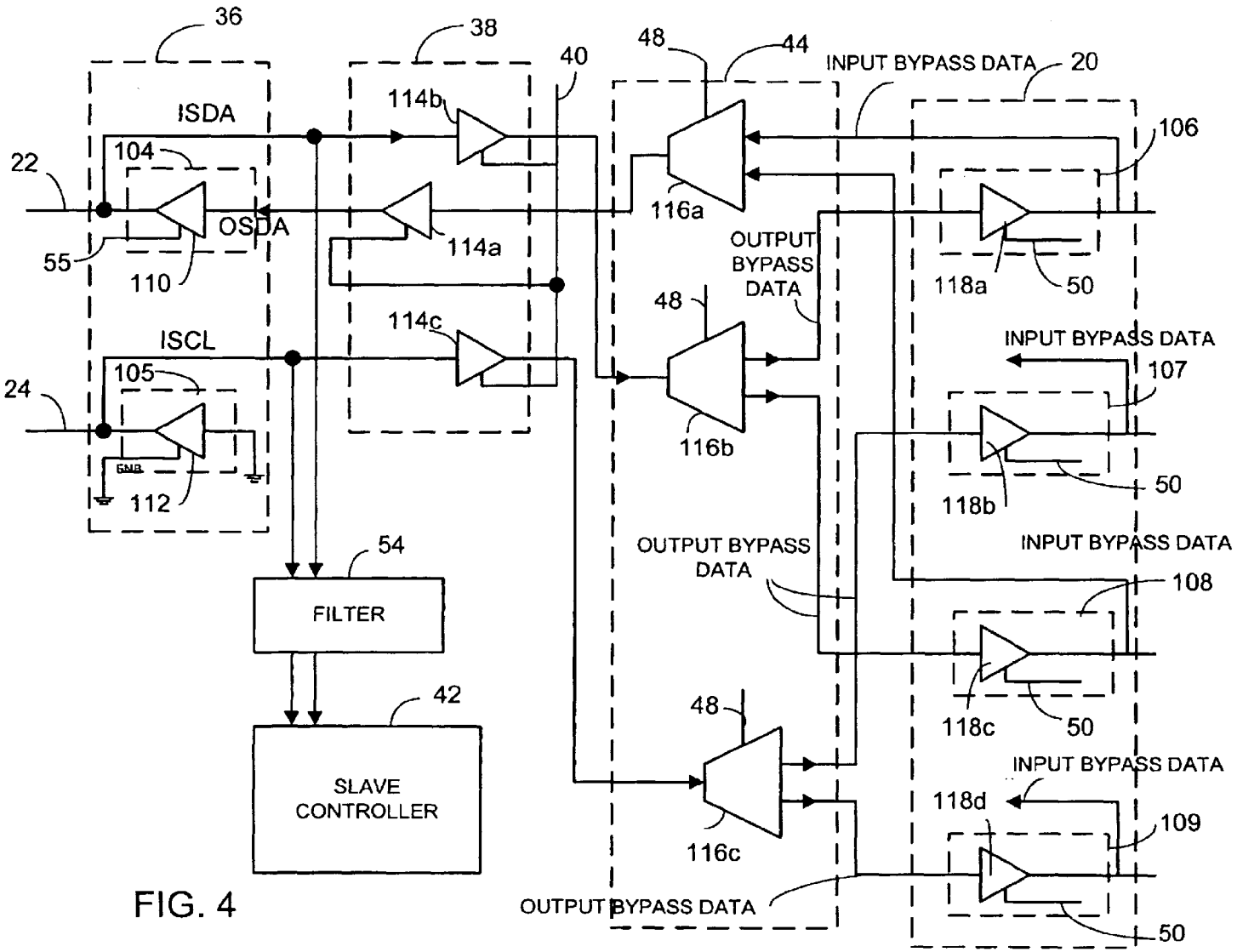
FIG. 4 is a circuit diagram illustrating one example of a bypass output multiplexor and shared bidirectional ports to facilitate serial communication for monitor detection of a plurality of differing display devices in accordance with the invention.

FIG. 4 shows in more detail one example of serial communication ports 36, bypass multiplexing circuit 38, output multiplexing circuit 44 and the shared I/O ports 20. As shown, the serial communication ports 36 may include a first port 104 and second port 105 having tristate buffer 110 and 112, respectively. Tristate buffer 110 is set in the tristate mode through direction enable signal 55 to receive input serial data (iSDA) from the data source. During non-tristate mode, the port serves as an output port for output serial data (oSDA) to output data to the source. The tristate buffer 112 or the serial clock line 24 may if desired always be in operational mode, as shown, unless a bidirectional clock line is also desired. Any data communicated in data signals 22 and 24, is passed through filter 54 to the slave controller 42 so that the slave controller can monitor activity of the data signal to know when to switch direction in the bypass mode.

The bypass multiplexing circuit 38 may be any suitable multiplexing circuit but is shown to be a plurality of tristate buffers configured to enable the data to pass directly from, and to, the output multiplexor 44 through the ports 36 and 20. The bypass multiplexing circuit 38 may include a plurality of tristate buffers 114*a*, 114*b* and 114*c* configured to facilitate bi-directional data flow to selected shared ports 20.

The output multiplexing circuit 44 includes a plurality of multiplexes 116*a*, 116*b* and 116*c*. These multiplexors selectively transfer data when the enable line 48 is activated by the slave controller. As shown, the slave controller may generate different control signals, for example, a bypass select signal for the serial data signal 22 and a bypass select signal for the serial clock signal 24. Output multiplexing circuit 44 is suitably controlled to allow the bidirectional transfer of data as necessary to determine the type of monitor or display device connected with the shared ports 20 and the data source 10.

The shared data ports 20 may be any suitable bidirectional ports. As shown in one embodiment, I/O ports 106–109 may include a series of tristate buffers indicated as 118*a*, 118*b*, 118*c* and 118*d*. It will be recognized that additional or fewer ports may be used depending upon the particular application. In this embodiment, the shared port associated with tristate buffer 118*a* and 118*c* can bi-directionally communicate data (input bypass data and output bypass data) as the serial signal 22. The shared ports associated with tristate buffer 118*b* and 118*d* output clock data or other data (output bypass data) communicated as the serial clock signal 24. They may also be used to input data (input bypass data) if coupled to a port 104 or 106.

It will be recognized that any suitable configuration may be used including allowing the tristate buffer 118*b* and 118*d* to also be connected to communicate data to either serial data lines 22 or serial clock line 24. Also as shown, another line 50 may include a number of different signals for enabling each tristate buffer individually to allow any shared port to communicate data with the serial data line and serial clock lines 22 and 24, respectively.

It should be understood that the implementation of other variations and modifications of the invention in its various aspects will be apparent to those of ordinary skill in the art, and that the invention is not limited by the specific embodiments described. It is therefore contemplated to cover by the present invention, any and all modifications, variations, or equivalents that fall within the spirit and scope of the basic underlying principles disclosed and claimed herein.

What is claimed is:

1. A serial communication circuit for facilitating communication between a display data source and a plurality of display devices comprising:

a register based display detection interface; and a display detection bypass circuit, operatively coupled to the register based display detection interface, that selectively bypasses the register based display detection interface to facilitate multi-protocol display detection of a plurality of display devices by the display data source.

2. The circuit of claim 1 further comprising shared bidirectional ports operatively coupled to the register based display detection interface and to the display detection bypass circuit, wherein the shared bidirectional ports selectively communicate data with the plurality of display devices from at least one of the register based display detection interface and the display detection bypass circuit.

3. The circuit of claim 2 wherein the display detection bypass circuit includes:

a bypass multiplexing circuit operatively responsive to a first control signal; and an output multiplexing circuit, operatively coupled to communicate selected display detection data from or to the bypass multiplexing circuit, wherein the output multiplexing circuit is responsive to a second control signal.

4. The circuit of claim 3 wherein the output multiplexing circuit is operatively coupled between the bypass multiplexing circuit and the shared bidirectional ports.

5. The circuit of claim 4 wherein the shared bidirectional ports are operatively responsive to a third control signal to facilitate multiprotocol communication with the plurality of display devices.

6. The circuit of claim 1 wherein the serial communication circuit is located on a separate integrated circuit from master control logic and wherein the serial communication circuit further includes a display device display engine.

7. The circuit of claim 6 wherein the display device display engine includes a ratiometric expander that ratiometrically expands display data received from the display data source for display on at least one of the plurality of display devices.

8. The circuit of claim 1 wherein the serial communication circuit is configurable to communicate display detection data with the plurality of display devices.

9. The circuit of claim 1 wherein the display detection interface bypass circuit selectively bypasses the register based display detection interface in response to bypass control data from the display data source.

10. A display data system for facilitating communication with a plurality of display devices comprising:

a graphics integrated circuit having a graphic data display engine; and a serial communication integrated circuit, operatively interposed between the graphics integrated circuit and the plurality of display devices having a register based display detection interface, and a display detection bypass circuit, operatively coupled to the register based display detection interface, that selectively bypasses the register based display detector interface to facilitate multi-protocol display detection of a plurality of display devices by a display data source.

11. The system of claim 10 further comprising shared bidirectional ports operatively coupled to the register based display detection interface and to the display detection bypass circuit, wherein the shared bidirectional ports selectively communicate data with the plurality of display devices from at least one of the register based display detection interface and the display detection bypass circuit.

12. The system of claim 11 wherein the display detection bypass circuit includes:

a bypass multiplexing circuit operatively responsive to a first control signal; and an output multiplexing circuit, operatively coupled to communicate selected display detection data from or to the bypass multiplexing circuit, wherein the output multiplexing circuit is responsive to a second control signal.

13. The system of claim 12 wherein the output multiplexing circuit is operatively coupled between the bypass multiplexing circuit and the shared bidirectional ports.

14. The system of claim 13 wherein the shared bidirectional ports are operatively responsive to a third control signal to facilitate multiprotocol communication with the plurality of display devices.

15. The system of claim 10 wherein the communication circuit is located on a separate integrated circuit from master control logic and wherein the communication circuit further includes a display device display engine.

16. The system of claim 15 wherein the display device display engine includes a ratiometric expander that ratiometrically expands display data received from the display data source for display on at least one of the plurality of display devices.

17. The system of claim 10 wherein the communication circuit is configurable to communicate display detection data with the plurality of display devices.

18. The system of claim 10 wherein the display detector interface bypass circuit selectively bypasses the register based display detection interface in response to bypass control data from the display data source.

19. A method for facilitating communication between a display data source and a plurality of display devices comprising the steps of:

receiving display detection bypass control data from the display data source; and selectively bypassing a register based display detection interface in response to the bypass control data to facilitate multi-protocol display detection of the plurality of display devices.

20. The method of claim 19 further comprising selectively communicating data with the plurality of display devices from at least one of the register based display detection interface and the display detection bypass circuit.

21. The method of claim 19 including ratiometrically expanding display data received from the display data source for display on at least one of the plurality of display devices.

22. The method of claim 19 including operating to communicate display detection data with the plurality of display devices.

23. The method of claim 19 including selectively bypassing the register based display detection interface in response to bypass control data from the display data source.

* * * * *